United States Patent [19]

Schippers

[11] 4,023,743

[45] May 17, 1977

[54] TEXTILE MACHINE, ESPECIALLY SPINNING MACHINE

[75] Inventor: Heinz Schippers, Remscheid-Lennep, Germany

[73] Assignee: Barmag Barmer Maschinenfabrik Aktiengesellschaft, Wuppertal, Germany

[22] Filed: Oct. 17, 1975

[21] Appl. No.: 623,477

[30] Foreign Application Priority Data

Oct. 17, 1974 Germany ..... 2449415

[52] U.S. Cl. ..... 242/35.5 A; 57/53; 242/18 A; 242/41

[51] Int. Cl.[2] ..... B65H 54/02; D01H 9/10

[58] Field of Search ..... 242/18 A, 35.5 A, 35.5 T, 242/41; 57/52–54

[56] References Cited

UNITED STATES PATENTS 3,905,184 9/1975 Takai et al. ..... 57/52

*Primary Examiner*—Richard C. Queisser
*Assistant Examiner*—Charles Gorenstein
*Attorney, Agent, or Firm*—Johnston, Keil, Thompson & Shurtleff

[57] ABSTRACT

An automatic spool changing system for textile machines with an array of high-speed winding heads, for example of the type having a spool revolver and a lossless thread transfer device. The system has a conveyor serving for the transportation both of full spools and empty spools and traversable along the machine front; and it has a spool changing carriage also traversable along the machine front, independently of the conveyor, and mounting a gripper movable between the conveyor and a spool holder in a spool changing position. The path of movement of the spool changing carriage as well as that of the conveyor lie vertically underneath each other and in generally the same vertical plane with the spool holder. The gripper has two angularly displaced heads and is arranged for axial translation and also for rotation in a vertical plane extending forwardly of the machine front. The gripper can thus execute a spool doffing and spool donning operation simultaneously. Controls for the spool changing system are also disclosed.

15 Claims, 26 Drawing Figures

TEXTILE MACHINE, ESPECIALLY SPINNING MACHINE

BACKGROUND OF THE INVENTION

Textile machines, especially spinning machines, with automatic spool changes are known in the art in various inplementations, in which like winding devices are arranged in tiers and in which there are provided horizontal spool spindles, a spool changing carriage traversable along the machine and a spool conveyor traversable along the machine independently of the spool changing carriage.

These spool changers serve to take the fully wound spools, i.e. the finished spools, off their spool holders, for example spool spindles, and place them on a spool transporting device, for example, a carriage or an endless conveyor. Beyond this the automatic spool changer also assumes the function of supplying the spool spindles with new spools from an empty spool storage device, for instance an empty spool magazine, an empty spool transport carriage or an endless conveyor.

An embodiment of such a spool changing arrangement has been disclosed, for example, in U.S. patent application Ser. No. 260,454, filed by Munnekehoff et al. on June 7, 1972, and now abandoned and corresponding to German published patent application No. DT-OS 2,128,974. This application shows a textile machine with one or more tiers of similar winding devices, a spool changing carrier which may be traversed along the textile machine and may be arrested in front of the textile machine in predetermined positions, and a spool conveyor which is traversable independently of the spool changing carriage. The spool changing carriage comprises means for taking off the finished spools and slipping on the empty spools.

Such an arrangement of textile machine, spool changing carriage and spool conveyor, which is distinguished by the fact that these three units are disposed, and are movable, in one plane side by side have proven themselves for textile machines for the processing of filaments, for example, crimp and false-twisting machines, without exhibiting any significant disadvantages for these machine types.

In other types of machines, especially spinning machines, spin stretching machines and stretch winding machines for synthetic yarns, this arrangement of the above-named three units entails, however, considerable drawbacks. Such machines are operated today at the highest thread velocities which may lie beyond 1,000 m/min and may reach more than 4,000 m/min. Frequently the freshly spun and/or stretched fiber material is highly sensitive. It tends to form lumps or defects in godets and winding devices. For economic reasons spools with a high filling ratio and a high spool weight, for example, 32 kilograms, are produced, particularly in the form of cylindric spools. The denier of the threads thus produced must always be chosen to conform to the changing requirements of the market. Because of all of these reasons it appears disadvantageous to locate the traversing paths of spool-changing carriages and spool conveyors in the service aisle of these machines. For this has the drawback that passage through the service aisle tends to be obstructed. Furthermore, the loose association of textile machine, spool changing carriage and spool conveyor does not permit either close service tolerances or the velocities which are necessary in order that the finished spools may be safely exchanged for empty spools within the technically imposed time limitations.

OBJECTS AND SUMMARY OF THE INVENTION

It is an object of the present invention to provide a spool changing arrangement comprising a spool changing carriage and spool conveyor, which is integrated with the design of the textile machine and particularly is optimally matched to the construction of the spinning plant or spin stretching plant, and which permits to match, within wide limits, both the cost and the operation of the automatic spool changer to the processing requirements of the spinning or spin stretching process.

It is therefore a particular object to provide an automatic spool changer of simple construction employing the simplest kinematic laws, to reduce the cost for the control of the individual motions and functions, to enhance operating capability and safety, and to facilitate economic use of the automatic spool changer within the wide technical limits of the spin or stretch-and-winding processes.

It is a further object to avoid obstruction by the spool changer of the service space forwardly of the machine front and thereby to avoid impeding the, partially time consuming and indispensable, service operations, for example, the clearing away of winding defects, and also interfering with maintenance and repair work.

With the foregoing and other objects in view the invention improves on textile machines of the known type initially referred to hereinabove, broadly speaking in that the projecting spool spindles, the path of movement of the spool changing carriage as well as the path of movement of the spool conveyor means lie vertically underneath each other forwardly of the machine front; that the spool changing carriage is traversable in a horizontal plane situated between the spool spindles and the path of movement of the spool conveyor means and that it carries a gripper comprising a gripper shaft extending perpendicularly to the machine front and being shiftable in a forward and rearward direction, and having mounted thereon at least one arm carrying a gripper head, the gripper head on its arm being movable along a path clear of said spool spindles, said spool changing carriage and said spool conveyor means; and that the spool changing carriage and the spool conveyor means are arranged to be arrested in predetermined locations such that at any time at least one spool spindle and one spool receiving device of the spool conveyor means lie on the path of movement of the gripper.

Preferably the spool changing carriage on its side facing the service front of the machine has legs with rollers, these rollers being guided in rails located in front of the spool conveyor means. According to another preferred implementation at least one of the gripper heads carries a slip-on mandrel which is axially slidable therein. In accordance with yet another feature the gripper has a crossarm, the two ends of which carry a gripper head for finished spools and a gripper head for empty spools, respectively, the gripper head for finished spools carrying the axially slidable slip-on mandrel and the gripper head for empty spools being in the form of a clamping sleeve with radially yieldable portions.

It has been found that economic use of automatic spool changers is possible in spinning and spin stretching machines only if the expense for the spool changer is matched to the requirements of the spinning process or spin stretching process. In the design of the automatic spool changers the denier of the produced synthetic yarn, the winding velocity, the dimensions of the finished spools as well as the properties of the produced material must be taken into account as determinative parameters for the design of the automatic spool changer. In the construction of the textile machine according to the invention broadly defined above, as well as its above mentioned advantageous implementations, this is possible, particularly in the production of synthetic yarns of low denier and correspondingly long yarn winding or collecting times and/or low spool weights if the further specific implementations defined hereinbelow are chosen. This includes designing the spool conveyor means in the form of a chain giuided along the machine front and having secured thereto, in projecting relationship and at a spacing corresponding to the machine pitch, slip-on mandrels serving as empty spool storage devices and full spool deposition locations. These implementations also allow spool changing for very short spool journeys and extremely rapid spool changes.

Reference may be made at this point to copending U.S. patent application Ser. No. 583,849, filed by Heinz Schippers et al., on June 4, 1975, on AUTOMATIC SPOOL-CHANGING APPARATUS and now abandoned. The contents of this copending application, as well as the other patents and patent applications referenced therein and also those referenced in the present application, should be considered incorporated herein for purposes of disclosure.

The spool changing system off this copending application Ser. No. 583,849, shows a conveyor moving along the machine front and a spool changer with a gripper movable between the conveyor and a spool holder in a spool changing position. The conveyor is located below and in generally the same vertical plane with the spool holder and the gripper which is arranged for both rotation and axial translation is mounted for movement along a three-legged spool doffing and spool donning path extending forwardly off the machine front. In one embodiment shown in the copending application the gripper has two angularly displaced heads such that a spool doffing operation and a spool donning operation can be executed simultaneously. However, in the arrangement of this copending application a separate spool changer, including the gripper and its controls, is individually mounted on and fixedly associated with each winding device. The present invention, in one aspect thereof, improves on the technique of the copending application by providing a gripper of somewhat similar kind but which is common to the various winding locations and which by means of the spool changing carriage on which it is mounted becomes only temporarily associated for service of any given individual one of these winding locations. The invention, according to a further development of this aspect, also provides the controls on the movable carriage for taking the gripper through its multi-legged path in a spool doffing and spool donning operation. The provisions, according to the invention, of a common gripper of the above general type and also of common control equipment for the multi-phase motion of this gripper results in a substantial saving both in initial cost and in maintenance as compared with the spool changing apparatus disclosed in the copending application.

BRIEF DESCRIPTION OF THE DRAWINGS

A preferred embodiment of the invention will now be described hereinbelow with reference to the accompanying drawings.

In the drawings.

DETAILED DESCRIPTION

Figure 1:
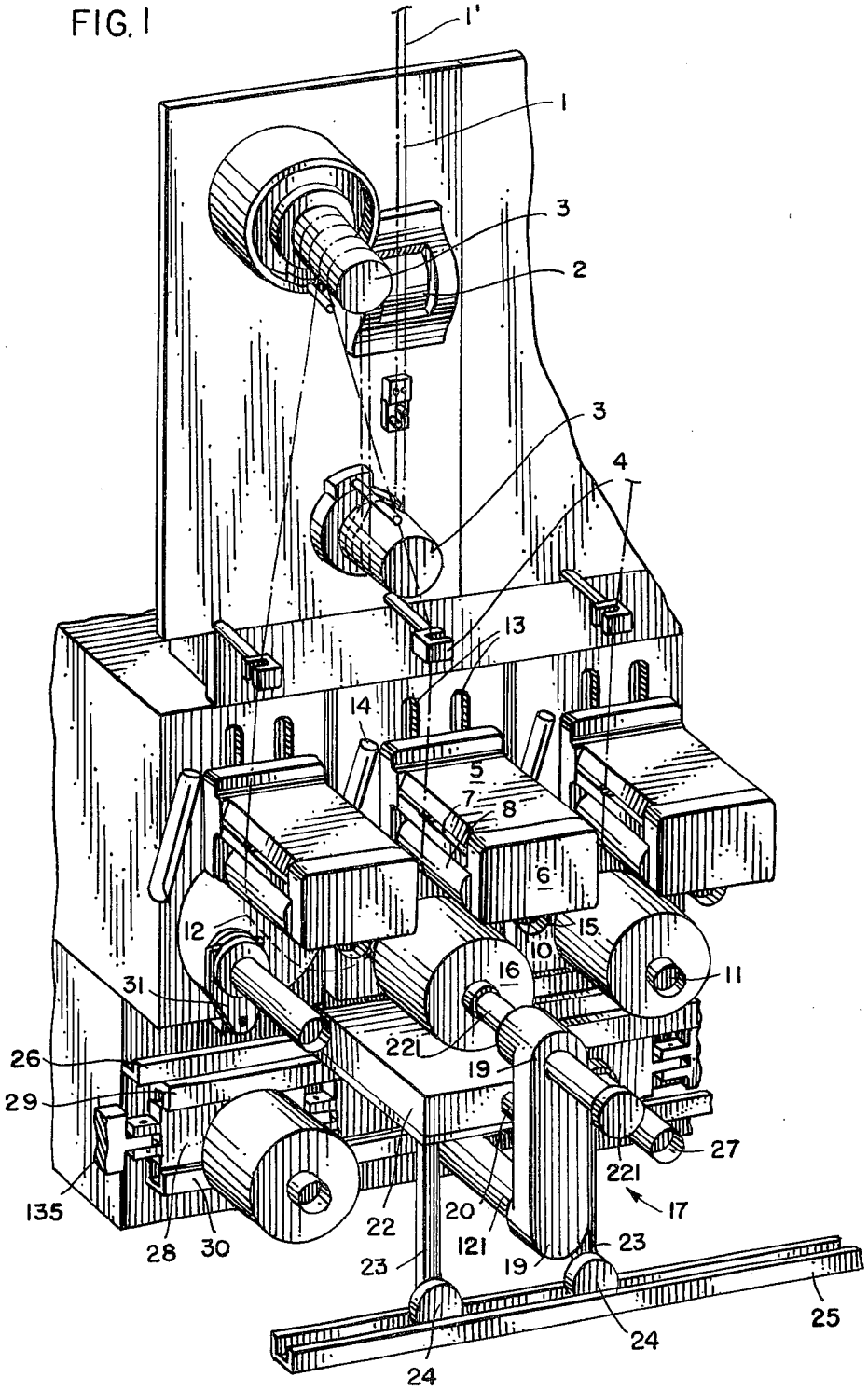
FIG. 1 is a perspective representation of a textile machine according to the invention; three winding stations of the machine and, in addition spool changing apparatus common to the individual machine stations, including the spool changing carriage and the spool conveyor, are shown.
Figure 2:
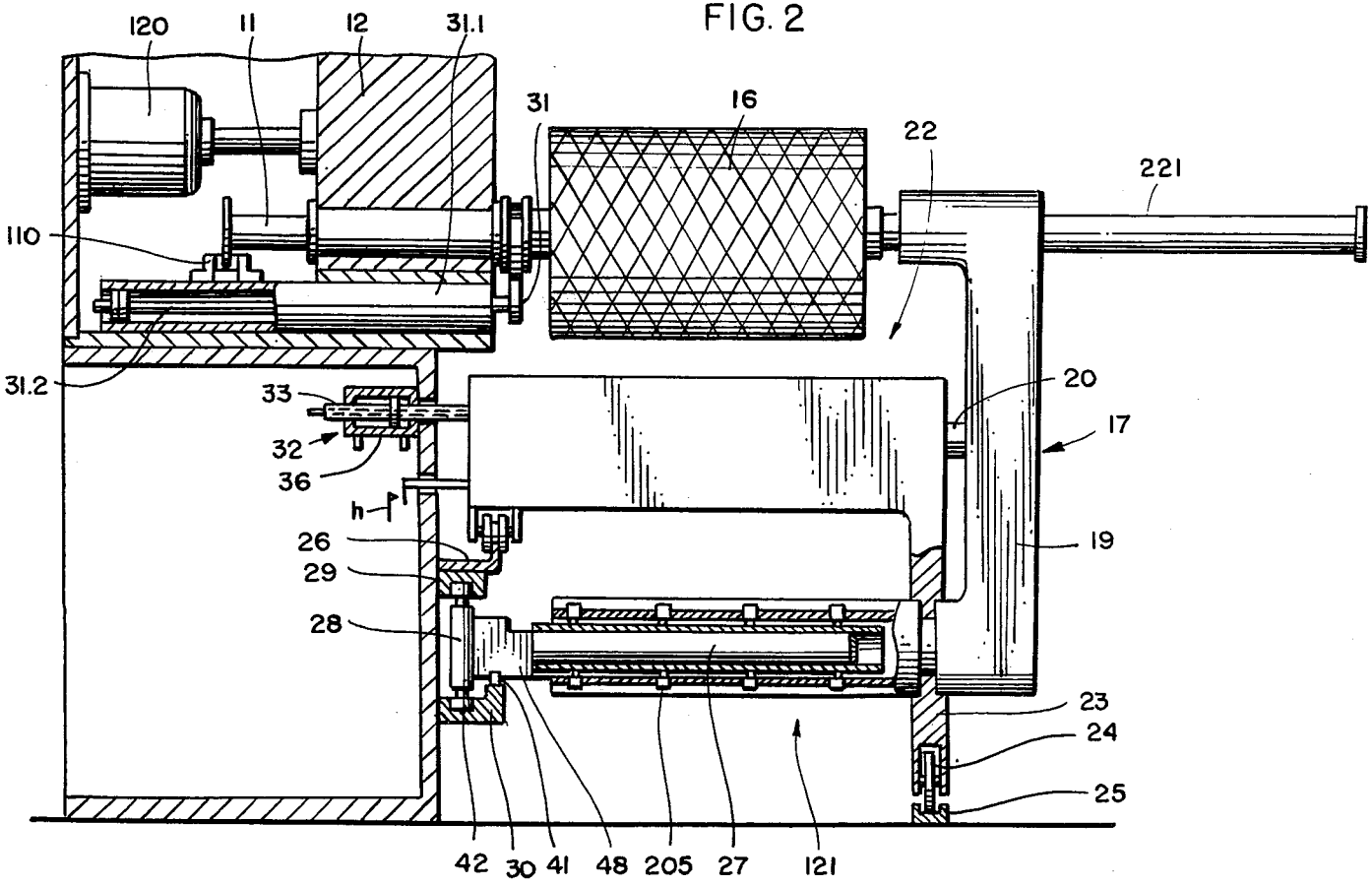
FIG. 2 is a partly schematic side elevational view of the center winding station shown in FIG. 1 while in spool changing condition, together with its common spool changing apparatus, certain parts being in longitudinal cross-section.

As illustrated in FIGS. 1 and 2, thread 1,1′ is fed, by a feeding device not shown, by means of finishing roller 2, stretching device 3 and thread cutting and suction devices 4, to winding devices 5. Suitable winding apparatus have been disclosed, for example, in U.S. patent application Ser. No. 456,222, filed by Erich Lenk et al. Mar. 29, 1974, on a Winding Apparatus and Process. Each winding device 5 essentially consists of a slide 6 which is vertically movable in guide grooves 13 and on which are mounted an associated traversing device 7, traversing roller 8 and a drive roller as well as the driving units, not shown herein, of the last-mentioned roller. Underneath slide 6 spool revolver 12 is rotatably mounted. Rotatable in and projecting from the spool revolver are the two winding spindles 10 and 11. Adjacent slide 6 on the side of traversing device 7, thread laying-on device 14 for lossless spool change is mounted on the machine frame. On the left one of the three spool changing devices 5 shown in FIG. 1 the full spool 16 has already been changed, on the center one the spool changing operation has just been initiated and on the right hand winding station the spool change is still forthcoming.

Figure 2A:
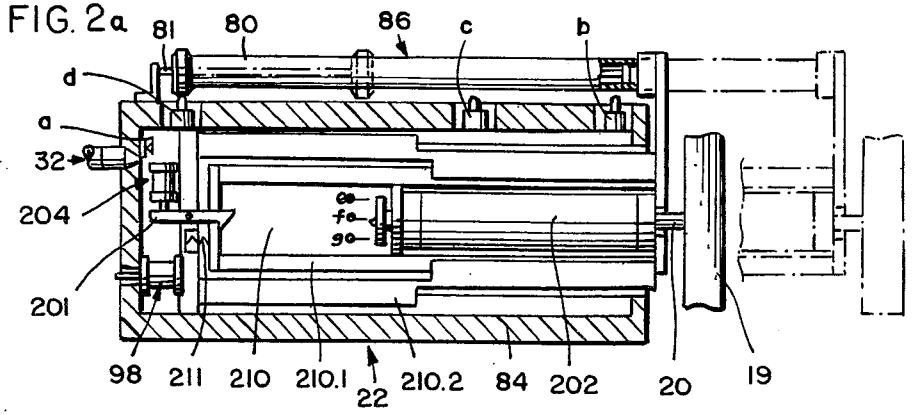
FIG. 2*a* is a longitudinal cross-sectional top view of the spool changing apparatus of FIG. 2, but, enlarged and with greater detail.

The automatic spool changer is disposed for traversing movement on the front side of the machine underneath spool revolver 12. The spool changer consists substantially of a spool changing carriage 22 which on the one hand is guided in a guide rail 26 mounted on the machine frame and which on the other hand glides, by means of legs 23 and rollers 24, in guide rail 25. The drive of the spool changing carriage is effected by means of a chain, not shown in FIG. 1, which is actuated by a motor likewise not illustrated. The spacing of legs 23 in the longitudinal direction of the machine is larger than the largest possible spool diameter. On the spool-changing carriage there is mounted a gripper 17. Gripper 17 comprises a gripper shaft 20 which, as schematically shown in FIG. 2, is supported perpendicularly to the machine front, in spool changing carriage 22. As shown in FIG. 2*a* and as explained in greater detail hereafter, gripper shaft 20 is forwardly and rearwardly movable by a cylinder/piston unit and is rockable by means of a rocking drive.

Figure 10A:
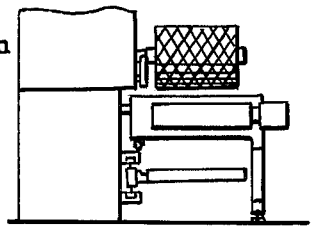
FIGS. 10*a*–10*n* are schematic representations of the various phases of a spool-changing operation, the illustrated apparatus being generally similar to, but differing in some details from, the apparatus of FIG. 1.
Figure 10B:
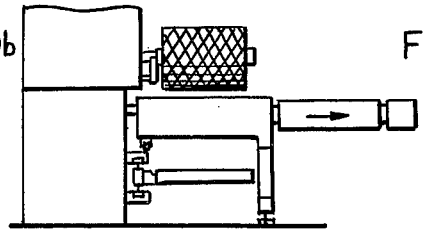
Figure 10C:
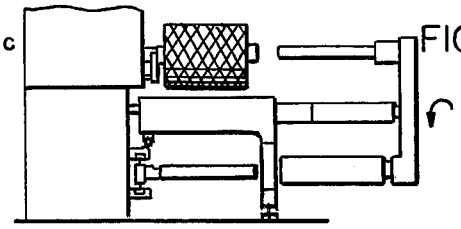
Figure 10D:
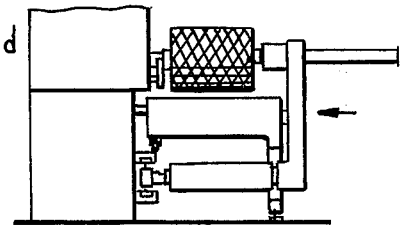

It may be mentioned at this point that in both FIGS. 1 and 2 the spool changer is shown in that phase near the beginning of its spool changing operation in which the gripper—after having been initially driven out and then rotated by 90°—has been driven in to receive the full spool 16 from spool spindle 11 and receive the empty sleeve carried by slip-on mandrel 27 carried by the corresponding plate 28 of spool conveyor 135. As described hereinbelow, this particular phase of the spool changing operation is schematically shown in FIG. 10*d*.

Secured to the gripper shaft 20 is a crossarm 19 by the end portions of which gripper arms 221,121, both extending in the direction of the machine, are carried respectively. Arm 221 which serves for the reception of the finished bobbin is axially shiftable through crossarm 19, a ball bearing 93 being provided in the corresponding gripper end for this purpose. As described more particularly with reference to FIG. 4 below, shifting of slip-on mandrel 221 relative to, and through, this gripper end is effected automatically when, incident to travel of the gripper to the left as viewed in FIG. 4, end face 222 of mandrel 221 comes into abutment with the end face of spindle 11 carrying the full spool (compare FIG. 2). This relative shifting takes place against the action of an air spring or "door check" 224 which is effectively interposed between mandrel 221 and the corresponding gripper end, and tends to return mandrel 221 to the condition shown in FIG. 4 where it assumes its extreme left position with respect to the aforementioned gripper end.

Gripper arm 121, FIG. 2, which serves for the reception of the empty tube consists of a hollow shaft with radially inwardly directed, movable chuck jaws which may be urged radially inwardly or may be withdrawn by means of a clamping device which may be operated pneumatically, magnetically or otherwise. In lieu of the gripper arms 221, 121 shown in FIG. 2, it is also possible to provide, at the extremities of the crossarm, gripping heads which are arranged to be moved into the spool sleeves and which receive the spool sleeves by means of clamping elements.

Spool spindles 10 and 11 are in the form of spool chucks. The spool chucks are preferably implemented by clamping members which are actuated by rotation of the spool sleeves.

The spool sleeves are slid from the spool spindles onto the slip-on mandrel of gripper arm 221 by means of a pushing-off device 31, one such device being provided at each winding station. An apparatus which may be used for this purpose has been disclosed in U.S. patent application Ser. No. 260,454, filed by Munnekehoff et al. on June 7, 1972, and corresponding to German published patent application No. DAS 2,438,363.

Spool conveyor 135 is disposed underneath the guide rail 26, FIGS. 1 and 2. The conveyor is in the form of a chain consisting of individual plates 28 which are articulated to each other. On each of these plates there is mounted a projecting slip-on mandrel 27. The conveyor chain thus formed is led around the machine by means of an upper guideway 29 and a lower guideway 30 secured relatively to the machine frame. The drive, not shown in FIG. 1, of the conveyor chain is located at the end of the machine (FIG. 6). Also not shown in FIG. 1 but illustrated in FIG. 5 described hereinbelow, is the positioning device for slip-on mandrel 27, which is provided at each winding station to insure that gripper 17 can reach not only spool spindle 10 or 11 but slip-on mandrel 27 as well.

As indicated above, in FIG. 2 which represents a partial view in longitudinal section through the center winding device shown in FIG. 1, the automatic spool changer is shown in spool changing condition. Visible in FIG. 2 is pushing off device 31 which consists of the axially slidable and rotatable piston 31.2 and cylinder 31.1. Above the pushing off device there is provided at the rear end of spool spindle 11 a braking device 110 for the braking of rotating spool spindle 11. Spool revolver 12 is rotated by motor 120. Underneath spool revolver 12 indexing valve 32 is shown mounted in the machine frame, the design of this valve being described in greater detail hereinbelow with reference to FIG. 3. This indexing valve for one thing has the function to precisely position the automatic spool changer and, for another, to supply the spool changer with the compressed air required for the operation.

Underneath indexing valve 32 there is disposed a switch *h* which is actuated by a cylinder/piston unit 98 from within spool changing carriage 22 (FIG. 2*a*). Switch *h* serves for the actuation of pushing off device 31. The design of spool changing carriage 22 will be explained in more detail hereinbelow with reference to FIG. 2*a*, and the design of the gripper with reference to FIGS. 4, 4*a* and 4*b*.

FIG. 2*a* is a cross-section through spool changing carriage 22. The figure shows that crossarm 19 of gripper 17 is mounted on gripper shaft 20. Gripper shaft 20 is mounted on a slide 210 which is translatable in spool changing carriage 22. Because of the necessary long stroke of gripper 17, the slide consists of two telescoped portions 210.1 and 210.2. The drive of the slide is effected by means of main cylinder 86 consisting of a cylinder/piston unit 80,81.

For the supply of gripper arm 121 with the required compressed air a bore is provided in gripper shaft 20. The inlet opening for this bore is disposed so that gripper arm 121 may be supplied with compressed air in any position of gripper 17.

Within translatable slide 210 rotary cylinder 202 is provided on the gripper shaft. This rotary cylinder has the function of rotating gripper 17 about the gripper axis by ±90° in the completely driven out position of the gripper. Provided on rotary cylinder 202 are switches *e*, *f* and *g* which are operated by the rotary cylinder in its three respective operating positions. Cylinder 80 in driving out, successively operates the three switches *d*, *c* and *b*.

In order to prevent the automatic driving out of gripper 17 as it is moved along the winding stations, there is provided in spool changing carriage 22 on slide 210 latch 201 which is operated by a cylinder/piston unit 204. In its normal position slide 210 is urged by damping member 211, for example a spring, against latch 201 to insure that the arresting of gripper 17 is free of play.

On the side of spool changing carriage 22 which is adjacent the front side of the machine, there is shown the inlet opening for the piston of indexing valve 32 which supplies the operating units mounted on the spool changing carriage with air under pressure. Underneath this inlet opening there is provided the previously mentioned cylinder/piston unit 98 which serves for the actuation of switch *h* mounted on the machine frame.

If compressed air is used as the operating medium switches *a* to *h* are in the form of valves. However, it is also possible to use operating media other than compressed air. For example, it is conceivable to provide electrical operating units for carrying out the required moving functions. In this case, of course, indexing valve 32 as such is not required. The supply of energy to spool changing carriage 22 could be effected, for example, by means of current conducting rails mounted on the machine frame, these rails being contacted by collector members provided on spool changing carriage 22.

Figure 3:
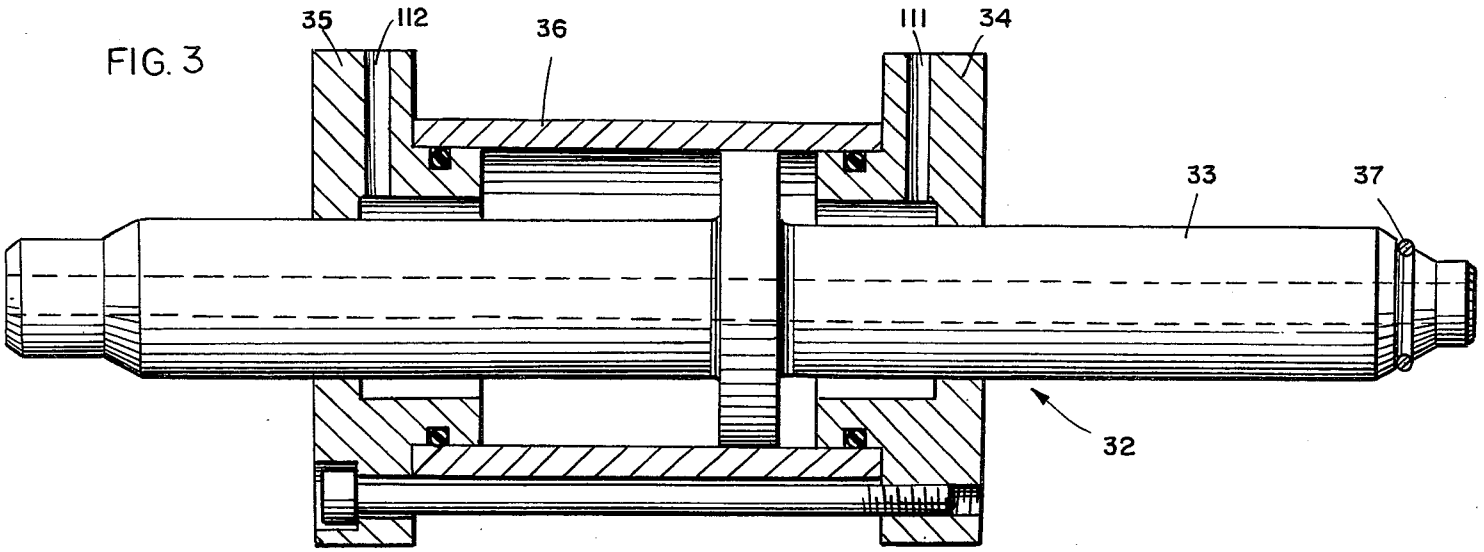
FIG. 3 is an enlarged cross-sectional view of the indexing cylinder/piston unit of FIG. 1, this unit also providing a compressed air connection for the gripper of the spool changing carriage.

In FIG. 3 indexing valve 32—necessary in case compressed air is used as the operating medium—is schematically illustrated. Inasmuch as it is a function of this device to position spool changing carriage 22 the device is provided at each individual winding station.

Indexing valve 32 essentially consists of a piston rod 33, the two face members 34 and 35 and a cylinder or sleeve member 36. In each of the two face members 34 and 35 there is provided a supply bore 111 and 112, respectively, to supply the air under pressure required for the driving in and driving out of piston rod 33. Piston rod 33 is provided with an internal axial bore to provide spool changing carriage 22 with air under pressure. The piston end which is insertable into spool changing carriage 22 is of conically tapering design and is provided with a gasket 37 to improve positioning as well as sealing against losses of compressed air. The control of indexing valve 32 is carried out by a register apparatus provided centrally on the machine, the function of this apparatus being described further below.

Figure 4:
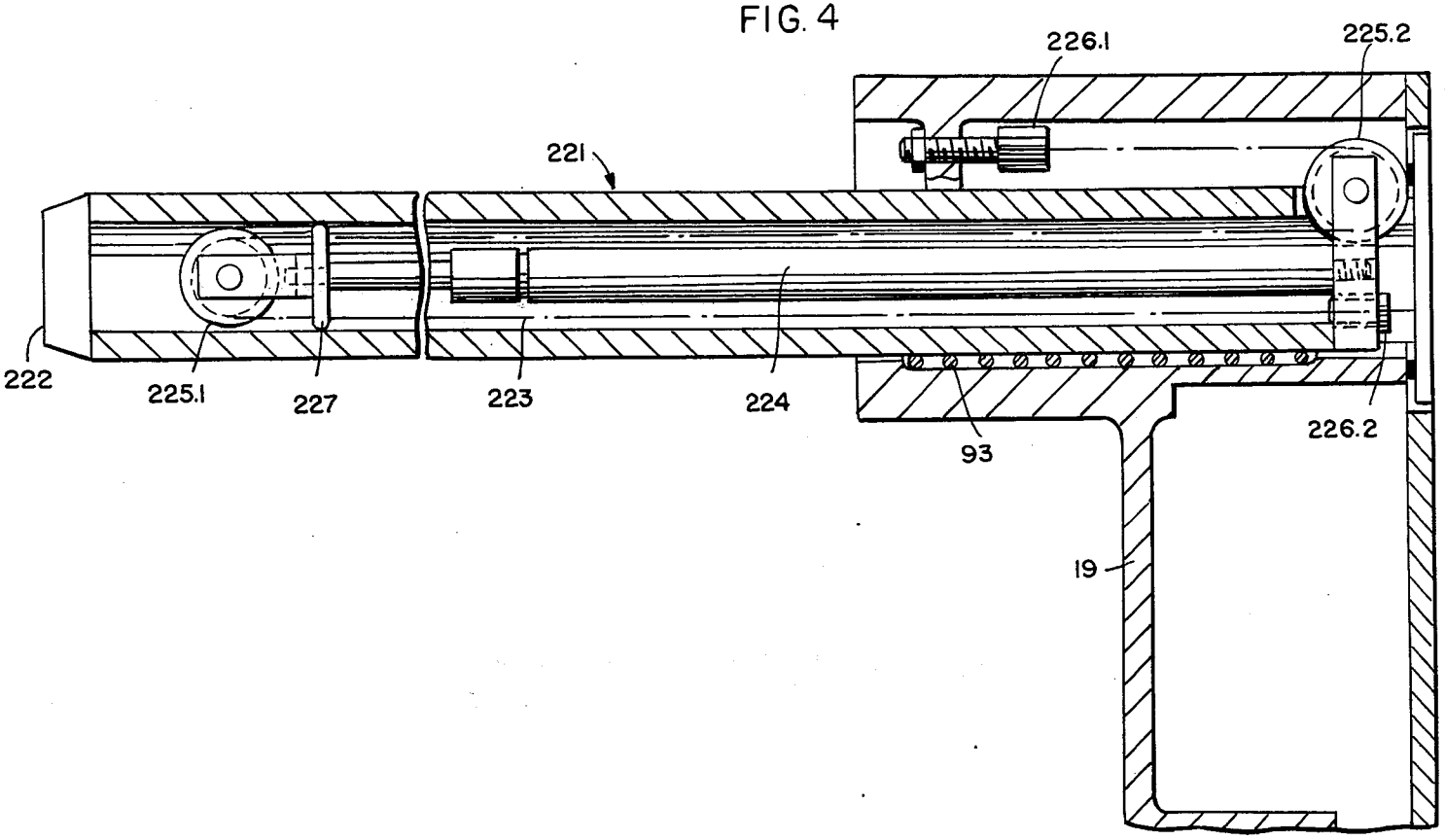
FIG. 4 is an enlarged cross-sectional view of the upper end portion, as viewed in FIG. 1, of the gripper crossarm together with its associated slip-on mandrel and "air spring" assembly.

FIG. 4 is a schematic detail representation of slip-on mandrel 221 which serves to receive the full spool. As indicated above, the slip-on mandrel is designed for axial movement through the corresponding end portion of crossarm 19 of gripper 17. The face (left) end 222 of slip-on mandrel 221 is tapered to facilitate its insertion into the spool sleeves. The diameter of slip-on mandrel 221 is chosen so that the spool sleeves may be readily slipped onto this mandrel. The connections of air spring 224—a commercially available device in the form of a cylinder/piston unit—to gripper end 91 and slip-on mandrel 221 are as follows: A cable 223 runs from its point of attachment 226.1 to the end portion of crossarm 19 via deflecting rollers 225.2 and 225.1 to clamping device 226.2. Clamping device 226.2 and deflecting roller 225.2 together with the cylinder of air spring 224 are mounted on the (right) end of slip-on mandrel 221, which is opposite to its end face 222. The free end of the piston rod of the air spring carries deflecting roller 225.1 and supporting or stabilizing disk 227. Inasmuch as the arrangement of the deflecting rollers and of the attachments of cable 223 corresponds to that of a simple block and tackle device, the piston rod 224.2 of air spring 224 requires a stroke only half as long as the axial stroke of gripper 17. The function of air spring 224 is to automatically move slip-on mandrel 221 into the postion shown in FIG. 4—provided there is no element abutting against end face 222 of the mandrel, which impedes this motion. The air spring is of a design such that the force produced by this device is independent of the amount of displacement of its piston.

Figure 4B:
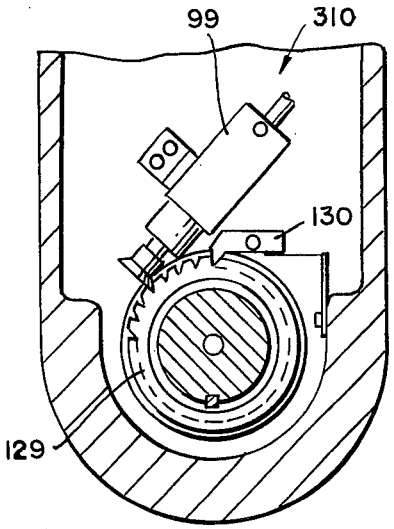
FIG. 4*b* is a partial sectional view taken on line IV-*b*—IV*b* of FIG. 4*a;*
Figure 4A:
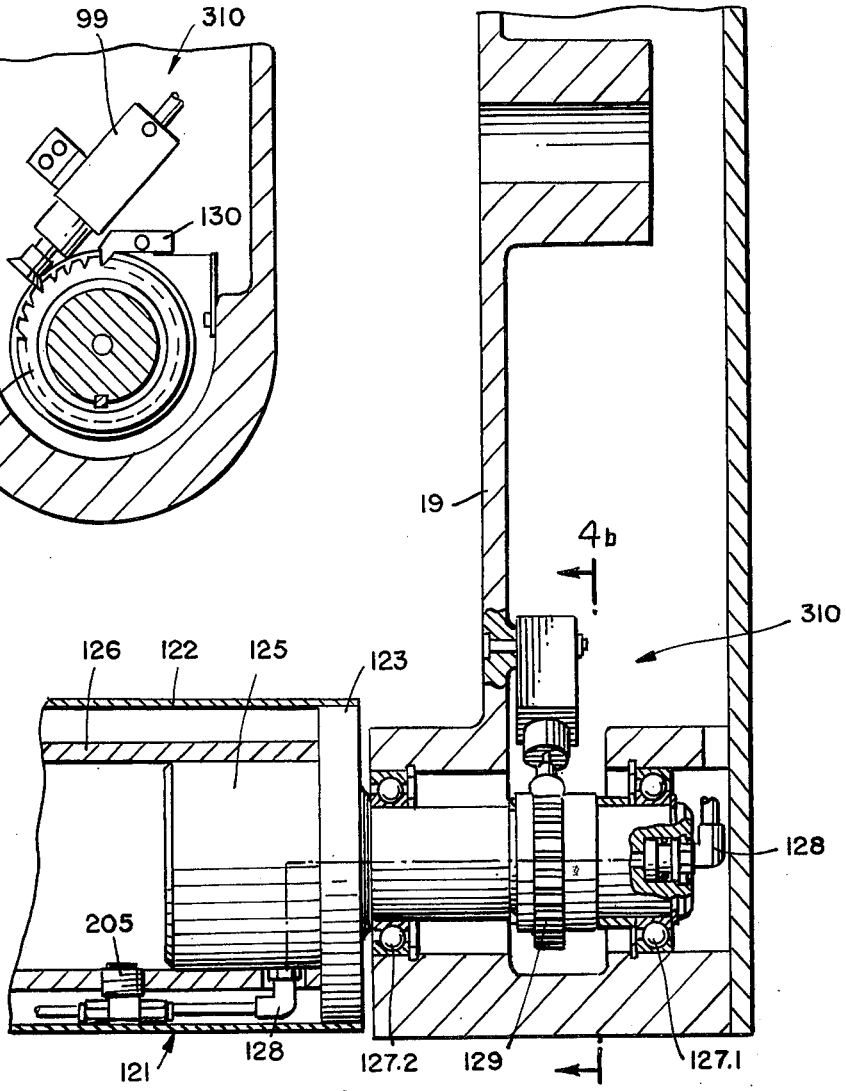
FIG. 4*a* is still another enlarged longitudinal cross-sectional view of the gripper arm of FIG. 1 as used for the mounting of the empty spool sleeve.

In FIG. 4*a* the gripper arm 121 serving for the reception of the empty spool is illustrated in greater detail. Gripper arm 121 consists of a journal pin 125, a sleeve 126 slid upon this pin and a sleeve 122 which serves as a cover. In the inner sleeve 126 there are provided clamping elements 205 each in the form of a cylinder/-piston unit. These clamping elements are supplied with compressed air through gripper shaft 20 and conduits 128. Preferably a plurality of clamping elements are provided in axially as well as circumferentially displaced relationship. The diameter remaining between the displaced clamping elements 205 in released condition must be greater than the external diameter of the empty sleeve.

Journal pin 125 is mounted for rotation in crossarm 19 by means of bearings 127.1 and 127.2. The rotary drive of the pin is effected by means of the "stepper" 310 and the pinion gear 129, the latter being mounted on journal pin 125. Stepper 310 is formed as a cylinder/piston unit 99 (FIG. 4*b*). This unit likewise is supplied with compressed air through gripper shaft 20. When the piston is driven out, the mushroom shaped end of the piston rod engages pinion gear 129 and rotates the latter by a certain amount. This amount is determined by the pitch of pinion 129 as well as by the stroke of cylinder/piston unit 99. When the piston of stepper 310 is retracted, stop pawl 130 keeps the pinion from being taken along. This gives rise to a stepping motion.

Figure 5:
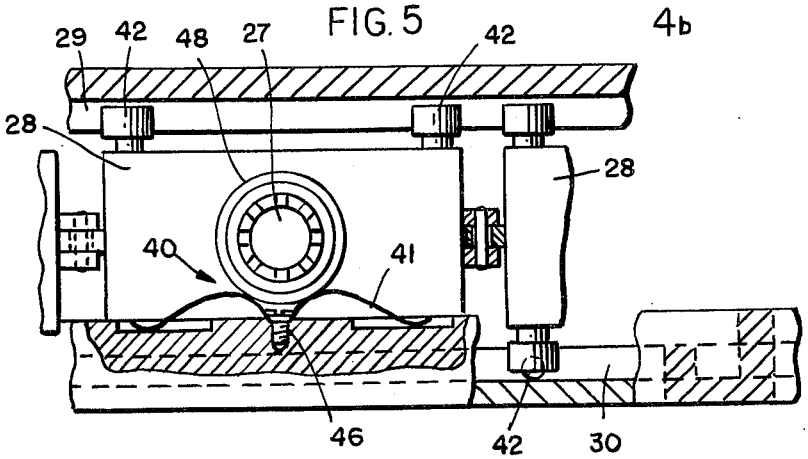
FIG. 5 is a partial front view of the spool conveyor shown in FIGS. 1 and 2, illustrating in detail the positioning arrangement of the conveyor.
Figure 6:
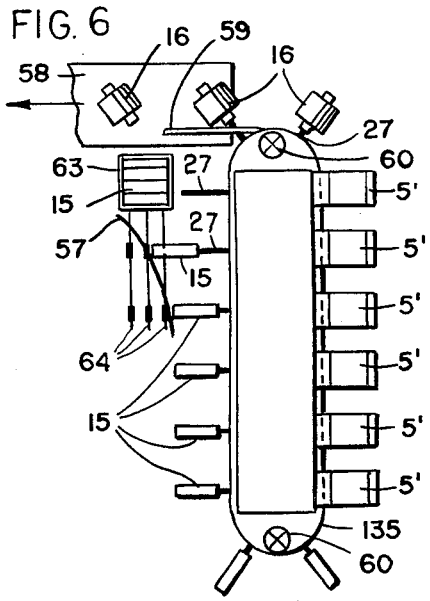
FIG. 6 is an overall schematic representation of the textile machine to illustrate arrangements used for removing the finished spool from the conveyor and for reloading it with empty tubes at the machine head.

In FIG. 5 an element of spool conveyor 135 is illustrated in greater detail. FIG. 5 shows how the individual plates 28 of which the spool conveyor is composed are flexibly connected to each other. The individual plates 28 are provided with two upper rollers or runners 42 and the lower runners 42'. The upper runners 42 are guided in guideways 29 and the lower runners 42' which simultaneously support the weight of plates 28 are guided in the lower guideway 30. Each winding device has associated therewith a positioning device 40. This positioning device consists, for example, of a leaf spring 41 having two saddle portions 41′, 41″. Between the two saddle portions leaf spring 41 is fastened with a screw 46.

When a slip-on mandrel 27 approaches a winding device the collar 48, FIG. 2, on which the slip-on mandrel is seated slides over the first saddle portion of leaf spring 41 and is accurately positioned between the two saddle portions so that gripper 17 can serve on the one hand the spool chuck with the full spool thereon, while in spool-changing position, and on the other hand slip-on mandrel 27. Since the individual chain members are yieldingly joined with one another, irregularities in the drive of the spool conveyor can be compensated for through the positioning of the individual members.

Figure 7:
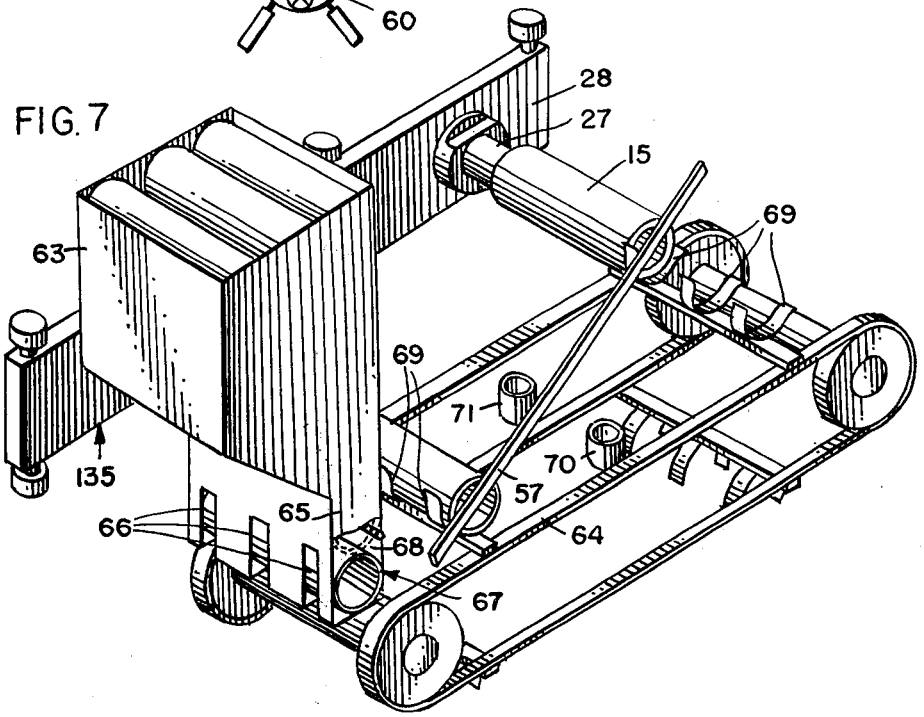
FIG. 7 is a perspective view illustrating apparatus for loading the conveyor with empty sleeves.

In FIGS. 6 and 7 arrangements for the removal of finished spools 55 from the slip-on mandrels 27 of the conveyor 135 according to FIGS. 1, 2 and 5, and for the slipping of empty tubes 56 onto these slip-on mandrels have been schematically indicated.

Figure 6A:
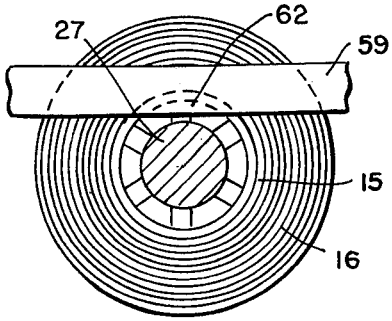
FIG. 6*a* is a detailed fragmentary view on an enlarged scale taken from FIg. 6.

As shown in FIG. 6, at the end of the textile machine with its winding devices 5, conveyor 135 is turned around in semicircularly shaped guides. In the path of one of these guides there is disposed a deflecting bar 59 in such a manner that the deflecting bar enters the recesses (FIG. 6*a*) between the collar 48 (FIG. 2) and sleeve 56 of finished spool 55 and strips sleeve 56 from slip-on mandrel 27 onto a conveyor 58. Conveyor 58 may transport the finished spool to a packaging apparatus, for example.

As described below with reference to FIG. 8, endless circulating chain 135 is intermittently driven at certain times. To this end there is provided in the circuit of motor 60 a clock 107 for the generation of a starting pulse, and a photocell 103 with a switch 109 for stopping motor 60 when a slip-on mandrel with an empty tube thereon appears within the detecting range of photocell 103. Thus, at the end of each predetermined interval, the chain is advanced by an amount such that a slip-on mandrel with an empty tube thereon is located under each winding device 5.

As shown in FIG. 7, for the supplying of slip-on mandrels 27 with empty tubes 56, the empty tube magazine 63 and the empty tube conveyor 64 are provided. Empty tube magazine 63 has in its lower part a chute 65 in which the empty tubes are "singled." The chute contains at its end three slits 66 as well as an outlet 67 which is closed by a resilient tongue 68. The empty tube conveyor 64 consists of two circulating chains. Its drive is synchronzied with the drive 60 of the conveyor 135, namely by means of a mechanical gear transmission 72 schematically shown in FIG. 7. By virtue of this gear transmission conveyor 64 operates whenever motor 60 is running. The individual chains carry clamping brackets 69 which resiliently engage and clamp the empty tubes on their periphery. The clamping brackets are designed in such a way that their opening points in the direction of travel of the conveyor. For the clamping of a tube, the clamping brackets move into the slits 66 of the chute 65 and thus grip the lowermost tube. Under the spring action of the tongue 68 the tube is pressed into the clamping brackets and thereupon led out from opening 67. Thereafter, the tubes can be thrust by guide arm 57 in axial direction onto the slip-on mandrels 27 which move parallel to and synchronously with the empty-tube conveyor 64 and the tubes clamped thereon. Sensing elements 70 and 71 which, for example, may be pneumatic sensing elements, monitor whether each slip-on mandrel 27 is fitted with an empty tube. In case of proper fitting, sensing element 71 gives a signal, and sensing element 70 no signal, when a tube passes there. Deviations from this signalling pattern lead to a warning signal for the operating personnel.

The spool change of the individual winding devices can take place cyclically or at random. It is to be observed that the gripper has to be out of operation as long as the conveyor is in operation, and that the finished spool subsequent to the spool change, i.e., after the swinging movement of spool revolver 12, must be drawn off the chuck in rest position as quickly as possible; otherwise there would be the danger that the spool in operation might grow against the finished spool, and that breakage of the winding apparatus would result. In order to take this into account, there has been developed an advantageous method for the operation of the spool-changing apparatus which will now be described with reference to FIG. 8.

Figure 8:
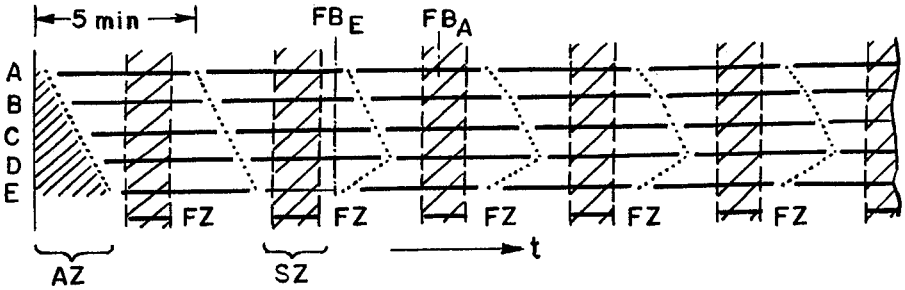
FIG. 8 is a chart to explain the coordination of the spool conveyor and the spool-changing apparatus with each other.

FIG. 8 shows in an operating chart or bar diagram the operating periods of, for example, five winding devices A –E. As will be noted from this figure and, as will now be described in more detail, the operation of the individual winding devices takes place in a cyclic, phase displaced manner. The time period for a spool journey (travel, "ride") is assumed to have been selected to be 5 minutes. In this time, optimal filling of the spools can be attained for the given conveying speed and denier of the threads. The starting operation and the initial application of the threads take 30 seconds per winding device, so that the application time (AZ) for all five winding devices is 2.5 minutes. The phase displacement of the spool journeys of the individual winding devices, which is caused by the application times for the individual winding devices, is preserved for the entire operating time of the textile machine with its winding devices, provided that thread breakages or other operating troubles do not occur in a winding apparatus. The case of operating trouble will be treated further below. First, let it be pointed out that the conveyor—as shown by bar diagram FZ—is taken into operation intermittently. The distance between the individual operating times corresponds to the adopted duration of a spool journey of 5 minutes. This means that in normal operation—i.e., without thread breakage—there could never occur any overlapping of the spool change with the conveying times (FZ) of the conveyor.

The functioning of the spool changing apparatus in the case of operational trouble will now be described on the basis of possible thread breaks.

The bar diagram of the winding apparatus E shows a thread break at the point FBE. This thread break lies outside the conveying time (FZ). For this reason the spool change can now take place without the need of further measures in the usual manner, namely, by rotating the spool revolver 12 until the empty tube is engaged by its peripheral drive, and the broken thread, sucked off temporarily by a suction device, is applied to the empty tube. Thereupon the spool-changing apparatus takes off the unfinished spool and replaces it by an empty tube sitting on the conveyor. The thread break at point FBE gives rise to a phase displacement in the operation of the winding apparatus E, which remains preserved in the future.

Now let it be assumed that a thread break takes place in the winding apparatus A at point FBA, namely, during the conveying time (FZ) of the conveyor. Through the operation of the conveyor both the rotary drive for the spool revolver 12, FIG. 2, and also the drive for spool changing carriage 22 and for gripper 17 are blocked on winding devices A – E. This blocking condition can only be removed when the conveyor has been reequipped with empty tubes and the individual slip-on mandrels with empty tubes have traveled back each to a winding apparatus. The thread breakage is now remedied and the spool change occurs as described above. The spool journeys of winding device A now have, with respect to the spool journeys of the other winding devices, a new phase displacement which remains preserved in the future. Let it be remarked that blocking takes place not just during the conveying time (FZ) of the conveyor but also during a certain safety interval (SZ) which is greater than the conveying time (FZ). During this safety interval already initiated spool changing operations can be completed, to be sure, but no new spool changing operations can be started.

The operation of the spool changing apparatus according to the invention shall now be explained in greater detail with reference to the operating chart of FIG. 9 and the diagram of FIG. 9*a*, and with the further aid of FIGS. 1, 10 and 2.

Figure 9:
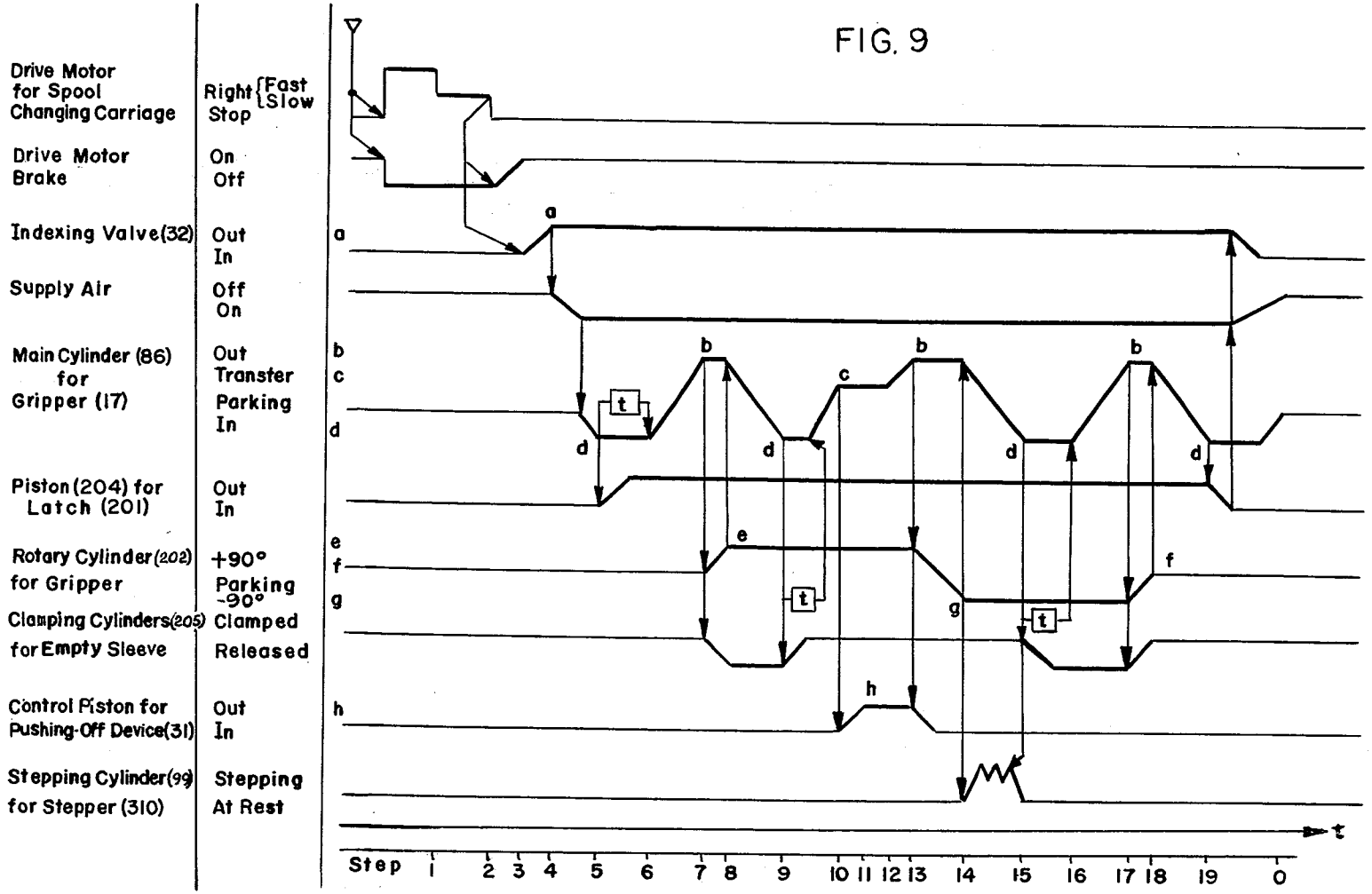
FIG. 9 is an operating chart to illustrate the sequencing and control of the spool-changing functions in the operation of the spool-changing apparatus.
Figure 9A:
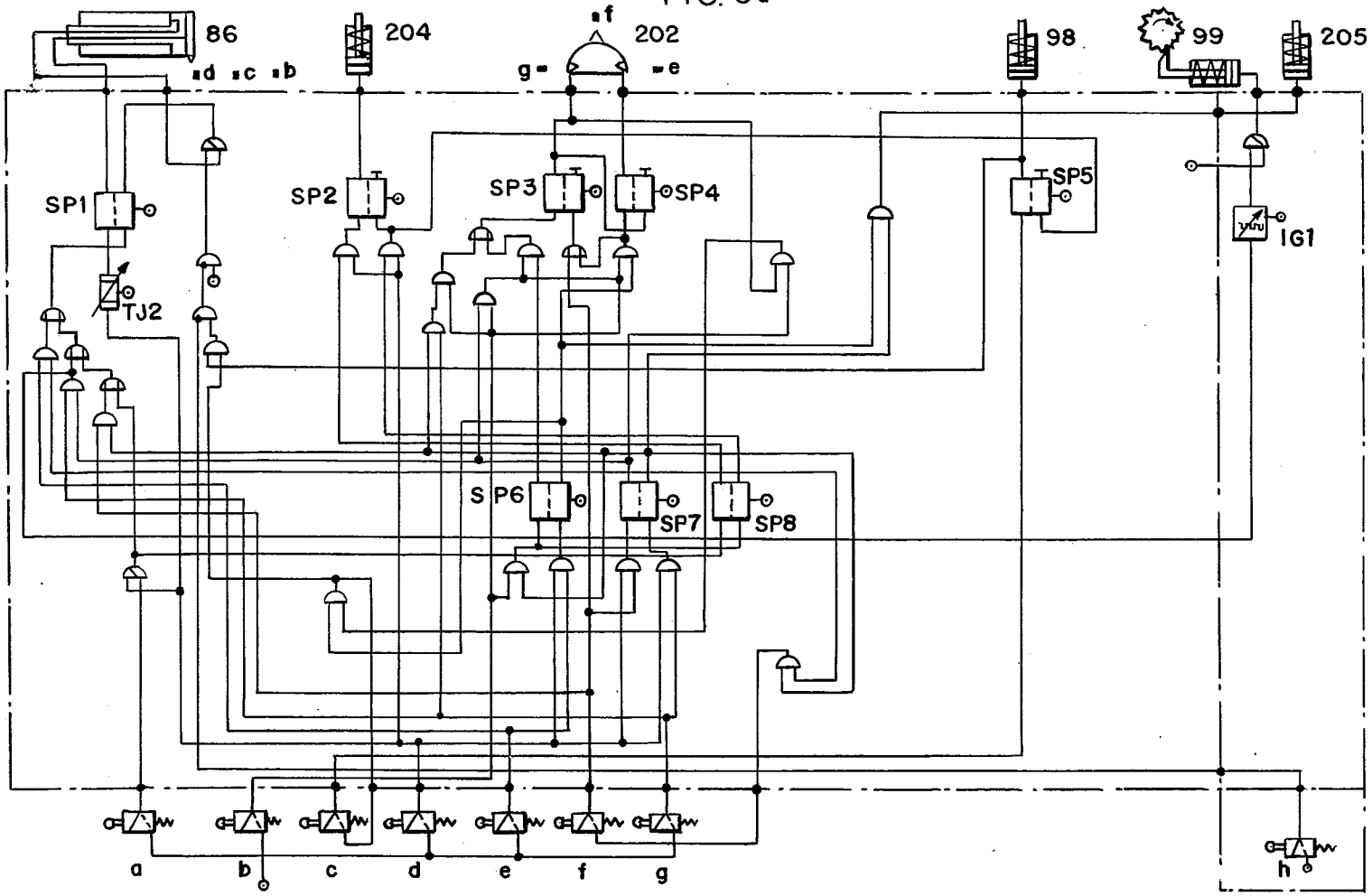
FIG. 9*a* is a schematic circuit diagram for the control and coordination of the individual sequential movements using logic elements.

As to FIG. 9*a*, it should be noted that this circuit diagram is shown for the case of pneumatic control; however, this diagram may also be implemented, in an analogous fashion, by means of electrically or hydraulically operable elements. The logic shown is located on the spool changing carriage itself. The following switches, all illustrated at the bottom of FIG. 9, and the following symbols have been used in circuit diagram FIG. 9*a*:

1. Switch *a* is operated by indexing valve 32 when the latter has positioned the spool changing carriage 22. The switch is located within spool changing carriage 22 (FIG. 2*a*). The operation of this switch leads to the retraction of gripper shaft 20 to its rear stop.

2. Switches *b*, *c* and *d*, all of which are also shown diagrammatically at the top of FIG. 9, are actuated upon the driving out of cylinder 80. Switch *b* is actuated when the gripper shaft has been fully driven out (FIGS. 10*b*, 10*c*, 10*g*, 10*h*, 10*k* and 10*m*). Switch *c* is closed by gripper shaft 20 in the spool transfer position (FIG. 10*e*), whereas switch d operates after gripper shaft 20 has been completely retracted (FIGS. 10*a*, 10*d*, 10*j*, 10*n*).

Figure 10E:
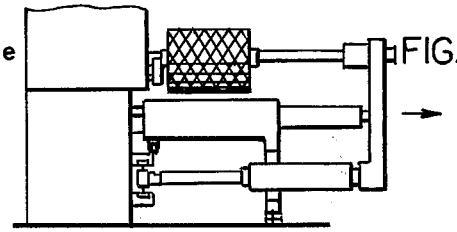
Figure 10F:
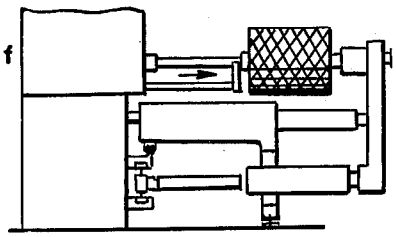

3. Switches *e*, *f* and *g*, each of which likewise is shown diagrammatically at the top of FIG. 9, are associated with the rotary drive 202 for gripper shaft 20. Switch *f* is closed in the horizontal position of crossarm 19 (FIGS. 10*a* and 10*n*). Switch *e* is actuated upon a 90° rotation of gripper 17 such that gripper arm 221 is positioned opposite spool revolver 12. Switch *g* is actuated upon a rotation of 180° relatively to this position (FIGS. 10*h*–10*k*).

4. Switch *h* is actuated upon simultaneous switching of *c* and *e* and it causes operation of pushing off device 31.

5. Elements SPE 1 to SPE 8 represent storage devices. Impulse generator IG 1 causes the oscillating (reciprocating) motion of cylinder/piston unit 99 of stepper 310. As to the remaining elements, apart from time relay TJ2 only AND, OR and NOR gates are used.

At each machine there is provided a storage and registration unit (not shown) which is operated by limit switches at each winding location. The function of the storage unit is, for one thing, to determine where spool changing carriage 22 happens to be at the time, to register the spools to be changed in the order of their urgency, and for another thing to clear the service request signal of spool locations already served. If spool changing carriage 22 is in standby or waiting position, that is, if it is not engaged in a changing operation at a different location, then it is moved to the calling location. If the spool changing carriage is still operating at a different winding head, then the signal is stored and the order is executed only when the spool changing carriage has reached its waiting position. All incoming spool changing signals are stored, and also executed, in the order of their receipt. If the parking time of a winding head is exceeded, then the winding head moves into an emergency position and the changing signal for the spool changing carriage is cleared; the thread must then again be laid on manually. Parking time is defined herein as the time which may lapse without the spool in the process of formation striking against the full spool which has not been changed as yet.

In both FIGS. 9 and 10 it has been assumed that— at the center winding station of FIG. 1, those spool changing operation is described herein by way of example—spool revolver 12 has already rotated full spool 16 into spool changing position and that the spool conveyor on its part has already moved a new empty sleeve to this winding device. On the other hand, it has been assumed that the spool changing carriage has not been transported to the winding station in question as yet but that it is still in the normal (waiting or standby) position, not shown in the drawings, of its path of travel along the machine front. It may further be helpful to note that the operational phases schematically represented in FIGS. 10*a* to 10*n*, respectively, correspond to steps 3,7,8,9,10,11,13,14,15,17,18 and 0 shown at the bottom of the operation chart FIG. 9.

In the present example it has been assumed that in order to reach the spool to be changed, spool changing carriage 22 must be transported to the right. As shown in FIG. 9, the motor serving for the drive of spool changing carriage 22 first receives from a switch S the signal "fast to the right" and then, shortly before reaching the winding location in question, in a manner not particularly shown, the signal "slow to the right" is received; see the first (top) line of FIG. 9. The drive for spool changing carriage 22 consists of a chain with a centrally located motor (not shown). In order that the motor for spool changing carriage 22 may be placed in operation, the brake of the driving motor is released simultaneously with the receipt of the motor control signal, see the second line of FIG. 9. After the spool changing carriage has arrived at the spool 16 to be changed, the driving motor is switched off, and simultaneously its brake switched on.

Incident to the switching on of the brake, the piston of indexing valve 32, FIG. 3, is simultaneously driven out by a control command from the registration unit so that a precise positioning of spool changing carriage 22 may be brought about. Upon the completion of the positioning operation, the supply air is turned on. More particularly, as a result of the positioning operation, switch *a* is operated in spool changing carriage 22 so that upon turning on of the supply air the main cylinder 86 for the driving in and driving out of gripper 17 can be actuated. At this time compressed air is connected to the main cylinder in such a way that it is completely driven in, the amount of displacement required at this instance amounting only to a few millimeters. In this fashion, latch 201 can be freed of tension and can be released by cylinder/piston unit 204. As indicated above, this latch 201 has the function of securing gripper 17 when in parking position against rotating and driving out during the time that spool changing carriage 22 is being transported; in this connection it should be borne in mind that the gripper is not supplied with compressed air during this transport time.

Simultaneously with the actuation of switch *d* time relay TJ2, FIG. 9*a* is actuated. This time relay, upon the lapse of a predetermined time interval, causes the main cylinder to be completely driven out (FIG. 10*b*). In this position switch *b* is operated so that, with switch *f* also being closed, rotary cylinder 202 of gripper 17 begins to rock about its axis. This causes gripper 17 to be rotated so that slip-on mandrel 221 of gripper 17, which serves for the receipt of the finished spool, is positioned in aligned relationship with spool chuck shaft 11 carrying the full spool. As a result of the foregoing, switch *e* is operated, this phase of the operation being illustrated in FIG. 10*c*. Subsequently, gripper 17 is driven in again. This means that the signal transmitted by switch *b* is extinguished and switch *d* is actuated again. In the course of this retracting motion the end face 222, FIG. 4, of slip-on mandrel 221 abuts against the end face of spool chuck shaft 11. Upon its continued driving in motion crossarm 19 is slid over slip-on mandrel 221. This causes the air spring 224 mounted in the slip-on mandrel to be tensioned. Also, incident to the inward motion of gripper 17, gripper arm 121 serving for the reception of the empty sleeve is slid over the empty sleeve located on the spool conveyor. To this end the cylinder/piston units 205 in gripper arm 121 are retracted (FIG. 9*a*). After gripper 17 has been completely driven in, the empty sleeve is clamped fast by means of the clamping cylinder provided in gripper arm 121 and main cylinder 86 drives gripper 17 out again (FIG. 10*e*). This driving out length amounts to only about 70 percent of the total stroke since subsequently the full spool is to be transferred from the winding device to the gripper arm. Switch *c* is now actuated by gripper shaft 20. Simultaneously with the operation of switch *c*, switch *h* which is mounted in the machine frame is actuated so that pushing off device 31 is enabled to push off the finished spool. The end face 222 of gripper arm 221, under the action of air spring 224, still abuts spool chuck shaft 11 (FIG. 10*f*).

Figure 10G:
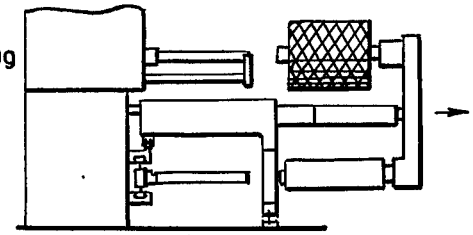
Figure 10H:
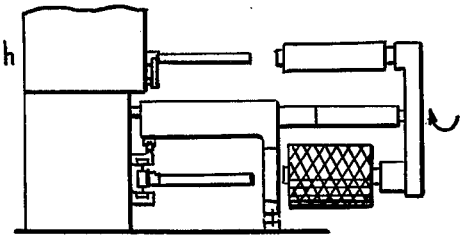
Figure 10J:
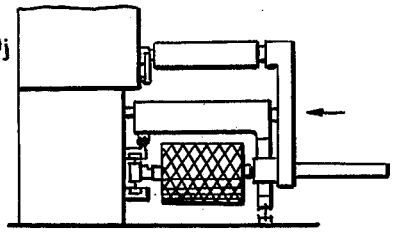
Figure 10K:
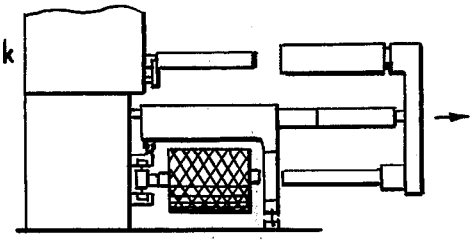

After full spool 16 has been completely slid onto gripper arm 221, gripper 17 is completely driven out (FIG. 10*g*). The control piston for pushing off device 31 is now driven in and this device consequently returns to its original position. Following this, rotary cylinder 202 for gripper 17 receives a control command and rotates gripper 17 by 180°, i.e. to its −90° position. Consequently, the control command emanating from switch *e* is terminated and switch *g* is operated. The foregoing rotation has the effect that gripper arm 221 with full spool 16 is now aligned with the empty slip-on mandrel 27 of the spool conveyor whereas the empty spool has been positioned by gripper 17 opposite spool chuck shaft 11 which now is also empty. As may be seen from FIG. 9, gripper 17 is now driven in again and, in the process, full spool 16 is slid onto slip-on mandrel 27 and the empty spool onto the spool chuck shaft. During this operation spool chuck shaft 11 or the empty spool must be intermittently rotated (stepped) since otherwise upon the first contact of the empty spool with the spool chuck shaft the spool chuck shaft would clamp onto the empty sleeve (FIGS. 10*h*,10*j*). Due to the fact that the inner end face of the crossarm slides the spool off the slip-on mandrel incident to the retraction of gripper 17, the full spool is freed of slip-on mandrel 221. In the process crossarm 19 is again slid over slip-on mandrel 221. After gripper 17 has been completely driven in, the clamping cylinders 205 in gripper arm 121 are released (by means of *d*, FIG. 9). Simultaneously, the stepping motion of gripper arm 121 is terminated. Gripper 17 is now completely driven out again (FIG. 10*k*). As a result, switch *d* is no longer operated and the signal coming from switch *b* reappears.

Figure 10M:
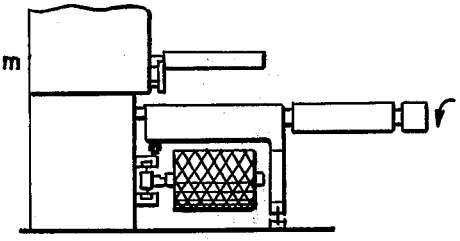
Figure 10N:
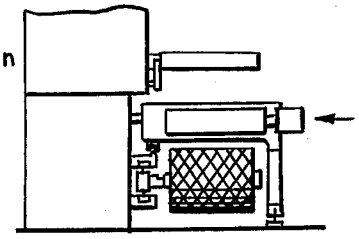

Subsequently gripper 17 is rotated again by 90 percent (FIG. 10*m*). As a result of this rotation, switch *f* is actuated. Thereupon gripper 17 is again fully retracted and simultaneously switch *d* is actuated. This has the effect that latch 201 by means of its cylinder/piston unit 204 is freed of tension and allowed to fall into locking position.

Following this the supply air is turned off and the piston of indexing valve 32 is retracted so that signal *a* is also terminated. Due to the turning off of indexing valve 32, the compressed air can escape from main cylinder 86 so that the damping elements move gripper 17 outwardly by a slight amount until latch 201 locks gripper 17 in position. The spool changer has thus returned to its normal condition (FIG. 10*n*).

Inasmuch as spool changing carriage 22 is now no longer needed by this winding station, it either returns to its waiting position or—if a new call request signal is present—moves onto a further winding station.

When the spool conveyor, as a result of the spool change, has been completely filled with full spools, the spool changing carriage first moves into its waiting position. Thereafter, the spool conveyor is served so as to change the full spools carried thereby against empty sleeves. After this has taken place (FIGS. 6,7), the empty sleeves are again moved underneath the winding station and, upon demand, the spool changer can continue its operation.

From the above description it will be clear that the foregoing invention, according to one of its aspects, enables a spool changing operation of a kind generally similar to that disclosed in the above Schippers et al. application, Ser. No. 583,849, to be executed with spool changing apparatus common to a plurality of winding stations. The cost for the spool changing equipment has thereby been substantially reduced.

I claim:

1. In a textile machine, especially a spinning machine, with like winding devices arranged in tiers and having horizontal spool spindles, a spool changing carriage traversable along the machine and spool conveyor means traversable independently thereof along the machine, the improvement that the projecting spool spindles, the path of movement of the spool changing carriage as well as the path of movement of the spool conveyor means lie vertically underneath each other forwardly of the machine front, that there are provided means for traversing the spool changing carriage in a horizontal plane situated between the spool spindles and the path of movement of the spool conveyor means and that the carriage carries a gripper comprising a gripper shaft extending perpendicularly to the machine front, there being provided means for shifting said shaft in a forward and rearward direction, and said gripper having mounted thereon at least one arm carrying a gripper head, the gripper head on its arm being movable along a path clear of said spool spindles, said spool changing carriage and said spool conveyor means, and that there are provided means for arresting the spool changing carriage and the spool conveyor means in predetermined locations such that at any time at least one spool spindle and one spool receiving device of the spool conveyor means lie on the path of movement of the gripper.

2. In a textile machine the improvement as claimed in claim 1 wherein the spool changing carriage on its side facing forwardly of the machine has legs with rollers, said rollers being guided in rails located in front of the spool conveyor means.

3. In a textile machine the improvement as claimed in claim 1 wherein said gripper has two arm-mounted gripper heads and wherein at least one of said gripper heads carries a slip-on mandrel which is axially slidable therein.

4. In a textile machine the improvement as claimed in claim 3 wherein the gripper has a crossarm the two ends of which carry a gripper head for finished spools and a gripper head for empty spools, respectively, the gripper head for finished spools carrying said axially slidable slip-on mandrel and the gripper head for empty spools comprising a clamping sleeve with radially yieldable portions.

5. In a textile machine the improvement as claimed in claim 4 wherein a cylinder/piston device is interposed between said slip-on mandrel and its associated gripper head, the air in said cylinder, upon rearward movement of said crossarm, being compressed upon abutment of the rear end of said slip-on mandrel with the front end of the spindle axially aligned with said mandrel and carrying a finished spool, said compressed air tending to maintain said slip-on mandrel in abutting condition with said spindle, and wherein there are provided pushing-off means at said machine front for sliding said finished spool off said spindle and onto said axially aligned mandrel during said condition of abutment.

6. In a textile machine the improvement as claimed in claim 4 wherein the spool conveyor means comprise a chain guided along the machine front and having secured thereto, in projecting relationship and at a spacing corresponding to the distance between adjacent spindles, slip-on pins serving as empty spool storage devices and full spool deposition locations.

7. In a textile machine the improvement as claimed in claim 1 wherein each winding location of the textile machine is equipped with an indexing device for the spool changing carriage and wherein there are provided switching means operated in response to the carriage drive being stopped at said winding location, for actuating said indexing device.

8. In a textile machine the improvement as claimed in claim 7 wherein said indexing device comprises a pin having an axial bore therein for supplying, in the indexed position of said spool changing carriage, compressed air to said carriage.

9. In a textile machine the improvememt as claimed in claim 8 wherein for the operation of said indexing device there is provided a cylinder/piston unit, the piston of said unit being integral with said indexing pin.

10. In a textile machine the improvement as claimed in claim 8 wherein there are provided on said spool changing carriage pneumatically actuated axial drive means shifting said gripper shaft in a forward and rearward direction and rotary drive means rotating said gripper shaft in a clockwise and counterclockwise direction, and also control logic means conducting said compressed air to said axial drive means and said rotary drive means in a programmed sequence.

11. In a textile machine the improvement as claimed in claim 10 wherein there is provided on said spool changing carriage a latch holding said gripper drive means in normal position during the travel of said carriage along the machine front, a pneumatically actuated control device controlling said latch, and means operating on said control logic means to cause the actuation of said control device at predetermined times.

12. In a textile machine the improvement as claimed in claim 1 wherein the spool conveyor means comprise a chain of individually movable conveying members yieldingly coupled to each other, and means for driving said chain lengthwise of the machine.

13. In a textile machine, especially a spinning machine, an arrangement for doffing finished spools from a spindle rotatably mounted in said machine, said arrangement comprising:

a slip-on mandrel axially aligned with said spindle, said mandrel being axially slidable in a gripper head and being normally disposed at a distance from said spindle;

a cylinder/piston device interposed between said slip-on mandrel and said gripper head;

means axially moving said gripper head with said slip-on mandrel therein in the direction of said spindle, the air in said cylinder incident to said movement being compressed upon abutment of one end of said slip-on mandrel with the adjacent end of said spindle, said compressed air tending to maintain said slip-on mandrel in abutting relation with said spindle;

means sliding said finished spool off said spindle and onto said slip-on mandrel during said condition of abutment; and means axially moving said gripper head with said slip-on mandrel and the finished spool now carried thereby, in the direction away from said spindle.

14. In a textile machine, especially a spinning machine, with like winding devices arranged in tiers and having horizontal spool spindles, a spool changing carriage traversable along the machine and spool conveyor means traversable independently thereof along the machine, the improvement that the projecting spool spindles, the path of movement of the spool changing carriage as well as the path of movement of the spool conveyor means lie vertically underneath each other forwardly of the machine front;

that the spool conveyor means have secured thereto, in projecting relationship and at a spacing corresponding to the distance between adjacent spindles, slip-on pins serving both as empty-spool storage devices and as finished-spool deposition locations;

that there are provided means for traversing the spool changing carriage in a horizontal plane situated between the spool spindles and the path of movement of the spool conveyor means and that the carriage carries a gripper comprising a gripper shaft extending perpendicularly to the machine front, there being provided means for shifting said shaft in a forward and rearward direction, and said gripper having mounted thereon a crossarm the two ends of which carry a gripper head for finished spools and a gripper head for empty spools, respectively, so as to simultaneously execute a spool doffing operation and a spool donning operation, there being provided means for rotating said crossarm in a forward plane clear of said spool spindles, said spool changing carriage and said spool conveyor means; and that there are provided means for arresting the spool changing carriage and the spool conveyor means in predetermined locations such that at any time one spool spindle and one slip-on pin of the spool conveyor means lie on the path of movement of the gripper.

15. In a textile machine the improvement as claimed in claim 14, wherein there are provided means for imparting on said gripper shaft with said crossarm thereon a multi-legged movement, said multi-legged movement including at least:

an axially forward shifting movement to cause said finished spool and said empty spool to be picked up by said two gripper heads from said spindle and from said slip-on pin, respectively;

a 180° rotation to cause the angular positions of said two gripper heads to be interchanged; and an axially rearward shifting movement to cause said finished spool and said empty spool to be deposited by said two gripper heads on said slip-on pin and on said spindle, respectively.

* * * * *